US005853209A

United States Patent [19]

McDermott

[11] Patent Number: 5,853,209

[45] Date of Patent: Dec. 29, 1998

[54] ANGLE ADJUSTABLE RAIN GUTTER CLEANING APPARATUS

[76] Inventor: Shaun H. McDermott, 563 Beck Rd., Loretto, Pa. 15940

[21] Appl. No.: 56,664

[22] Filed: Apr. 8, 1998

Related U.S. Application Data

[60] Provisional application No. 60/043,081 Apr. 8, 1997.

[51] Int. Cl.[6] ..... E04D 13/076

[52] U.S. Cl. ..... 294/19.1; 15/236.04

[58] Field of Search ..... 294/19.1, 22, 23, 294/50.8, 50.9, 53.5, 103.1, 104; 15/105, 236.04; 56/333, 334

[56] References Cited

U.S. PATENT DOCUMENTS

| | | | |
|---|---|---|---|
| 2,720,409 | 10/1955 | Griffith | 294/19.1 |
| 2,817,867 | 12/1957 | Bugbird | 294/19.1 X |
| 3,023,971 | 3/1962 | Milhous . | |
| 3,601,835 | 8/1971 | Morgan | 294/19.1 X |
| 4,057,276 | 11/1977 | Currie | 294/19.1 |
| 4,196,927 | 4/1980 | Lomaga | 294/19.1 |
| 4,303,348 | 12/1981 | O'Brien . | |
| 4,447,927 | 5/1984 | Malless, Jr. . | |
| 4,502,806 | 3/1985 | Albertson . | |
| 4,930,824 | 6/1990 | Matthews et al. . | |
| 5,288,118 | 2/1994 | Hartselle, III . | |
| 5,435,612 | 7/1995 | Kreiser . | |
| 5,626,377 | 5/1997 | Carroll et al. | 294/19.1 |

*Primary Examiner*—Jonny D. Cherry
*Attorney, Agent, or Firm*—Richard C. Litman

[57] ABSTRACT

A rain gutter cleaning apparatus for remotely cleaning a house gutter of accumulated leaves and twigs while operating the apparatus from ground level. A clamping device is operated by a cable located within an elongated tubular rod. The angle between the rod and the vertical clamp is adjustable for differences of height between the ground and the rain gutter.

7 Claims, 3 Drawing Sheets

ANGLE ADJUSTABLE RAIN GUTTER CLEANING APPARATUS

CROSS-REFERENCE TO RELATED APPLICATION

This application claims the benefit of U.S. Provisional patent application Ser. No. 60/043,081, filed Apr. 8, 1997.

BACKGROUND OF THE INVENTION

1. Field of the Invention

The present invention relates to a rain gutter cleaner apparatus having an adjustable angle which maintains the vertical position of the clamp in the gutter for varying distances from the ground surface. The operator remains close to the dwelling having up to three floors. The gutter cleaner has multiple uses in collecting the debris in a rain gutter and picking up the piled debris with the clamping element. The clamping element has bristled surfaces which scrub the gutters and the valleys of a roof.

2. Description of Prior Art

The prior art describes various rain gutter cleaners with clamps, brushes, and water hoses. The prior art will be discussed in the order of perceived relevance to the present invention.

U.S. Pat. No. 4,930,824 issued on Jun. 5, 1990, to Thomas R. Matthews et al. describes a gutter cleaner for remote cleaning from the ground. A pair of cooperating fork-like jaws is mounted on the upper end of a telescopic handle which can extend 5–30 feet and having a clevis on a sleeve for tying the rope down which operates the rake jaws. An adjustment screw at the upper end of the handle can orient the rake for different heights. The rake jaws are oriented in the gutter to close by abutting the side walls. This orientation is opposite to that of the device of the present invention. The rake with spread apart fork fingers as oriented, thus cannot clean the gutter more thoroughly, push the debris to form a pile, and gather the debris in the gutter as in the present invention.

U.S. Pat. No. 4,502,806 issued on Mar. 5, 1985, to Edward Albertson describes a long handled (5–20 ft.) gutter cleaning device having three interchangeable heads comprising a roof rake, a pair of slotted cleaning plates and a hose clamp. The upper end of the aluminum handle is shaped as either an inverted V or U. The latter configuration requires three bends. The cleaning plates have angled lip portions extending away from the central axis. The plates have aligned slots in their upper portions which permit the changing of the angular relationship between the handle and the paired plates. The plates must be less than one-half the bottom width of the gutter. By rotating the handle, the plates are flicked back and forth to propel the debris out of the gutter. The use of this apparatus is diametrically opposed to the present invention which collects the debris between the clamp to clean the gutter.

U.S. Pat. No. 4,303,348 issued on Dec. 1, 1981, to Edward P. O'Brien describes a water supplied gutter cleaning device having scraper blades and a centered vertically positioned brush at the end of an elongated handle. The present invention does not require the use of a conduit-handle for cleaning liquid. The apparatus also lacks the adjustable angle feature of the present invention.

U.S. Pat. No. 3,023,971 issued on Mar. 6, 1962, to Samuel E. Milhous describes a long handled gutter cleaning device using a water hose incorporated inside the handle and connected to a vertically supported rake with four curved tines. The rake and hose outlet is hinged to the handle to rotate in a direction along the longitudinal axis of the handle. Therefore, the rake can only be positioned with its width along the longitudinal axis of the gutter. In contrast, the present invention precludes the use of water and orients the clamps across the width of the gutter.

U.S. Pat. Nos. 4,447,927, 5,435,612, and 5,288,118 issued respectively to George C. Malless, Jr. on May 15, 1984, Lois A. Kreiser on Jul. 25, 1995, and William Hartselle, III on Feb. 22, 1994, describe long handled gutter cleaning devices based on various scoop forms to collect the debris. The present inventive device collects by clamping the leafy debris.

None of the above inventions and patents, taken either singularly or in combination, is seen to describe the instant invention as claimed. Thus, a rain gutter cleaner solving the aforementioned problems in a crowded art is desirable.

SUMMARY OF THE INVENTION

The present invention provides a rain gutter cleaner apparatus having an adjustable angle which maintains the vertical position of the clamp in the gutter for varying distances from the ground surface as the length of the telescoping pole is varied. The operator remains close to the dwelling which can be as high as three stories. The gutter cleaner can collect debris in a rain gutter and pick up the piled debris with a clamping element. The clamping element has bristled surfaces which can also scrub the gutters and the valleys of a roof.

Accordingly, it is a principal object of the invention to provide a remote gutter cleaning device which piles and picks up the debris in a gutter or in the valleys of a roof.

It is another object of the invention to provide a remote gutter cleaning device which permits the operator to remain close to the building while cleaning the gutters and valleys.

It is a further object of the invention to provide an adjustment of the angle between the clamp and the telescoping pole.

Still another object of the invention is to provide a means for maintaining the clamped position of the cleaning device.

It is an object of the invention to provide improved elements and arrangements thereof in an angle adjustable rain gutter cleaning apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a rain gutter and roof valley cleaning apparatus having a cleaning element adjustable in inclination relative to the elongated telescoping rod element. The cleaning element comprises a clamp with opening means and a closing means. The individual clamp arms have either a plastic guard strip or a brush on the outside forward edges. The guard strip prevents damage to the gutter walls from scraping. The brush aids in cleaning the walls and bottom of the gutter.

Figure 1:
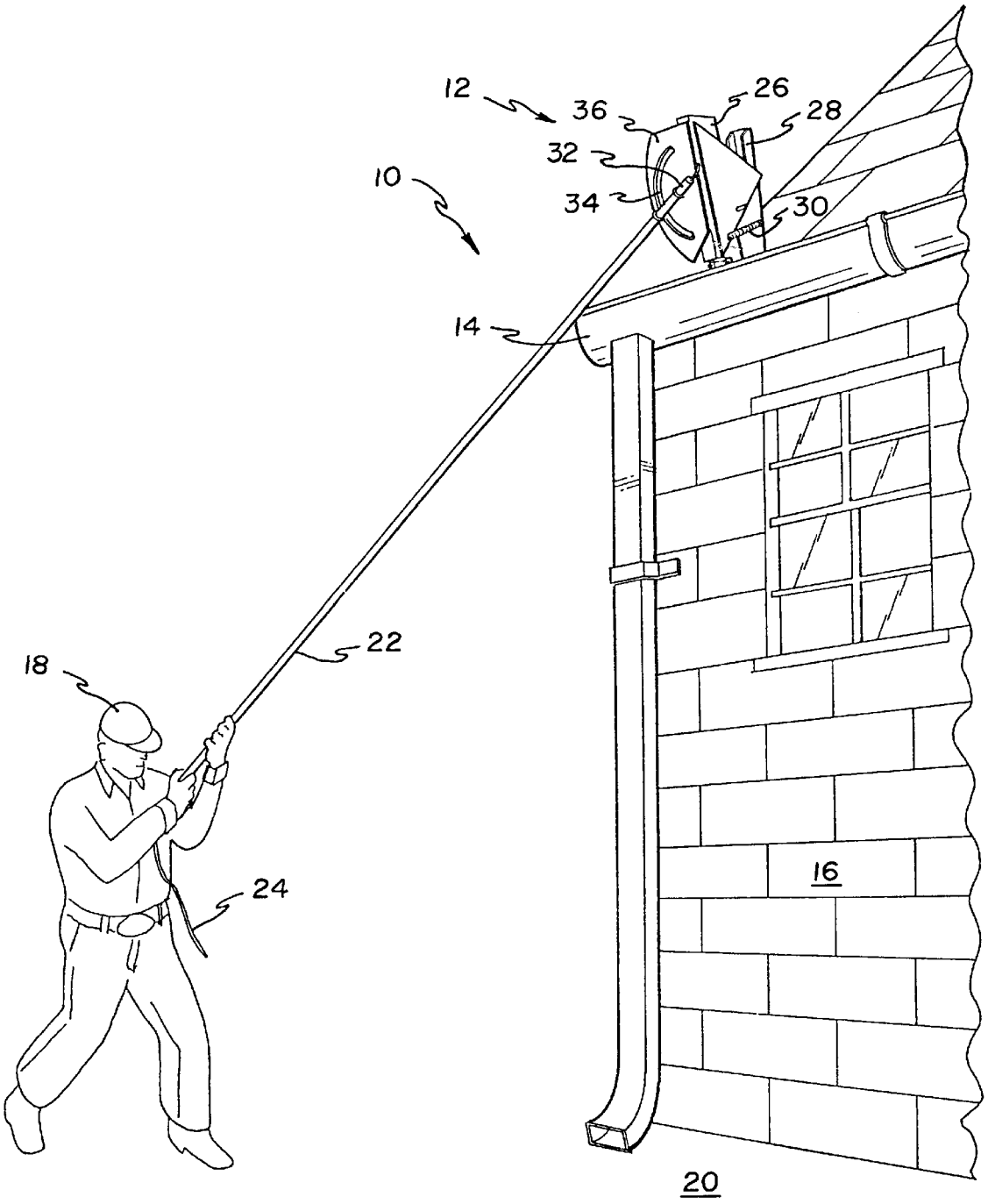
FIG. 1 is an environmental, perspective view of an angle adjustable rain gutter cleaning apparatus according to the present invention.

FIG. 1 illustrates the position of the rain gutter cleaning apparatus 10 with its cleaning element 12 positioned in the rain gutter 14 of a house 16 (partially shown), and the apparatus 10 being operated by a person 18 on the ground 20. The cleaning element 12 made of aluminum alloy parts is held by an elongated telescopic hollow pole 22 made of aluminum alloy. Although a single story house 16 is depicted, the present invention can be utilized to clean the gutter 14 of a three-story house by simply extending the length of the hollow pole 22 which can be further segmented for convenience.

By pulling down on the braided steel cable 24 which runs through the hollow pole 22, the person 18 can now open the jaws 26 and 28 and retain this open position by holding on to the cable 24. When the cable 24 is released, the stretched spring 30 will contract to close the jaws 26 and 28.

It is also contemplated to provide a hole in the lower part of the pole 22 from which the cable 24 can emerge with a gripping means consisting of a metal sleeve with a clamping means (not shown) to fasten to the cable 24. The gripping means can also be utilized with the cable 24 issuing from the bottom end of the pole 22.

The jaws 26 and 28 are preferably in a vertical position in the gutter 14. In order to maintain this vertical position, the apparatus 10 maintains this position by adjusting the inclination of the jaws 26 and 28 by initially positioning the pole's top end 32 at a suitable angle with the jaws in a groove or curved aperture 34 in the angle plate 36.

Figure 2:
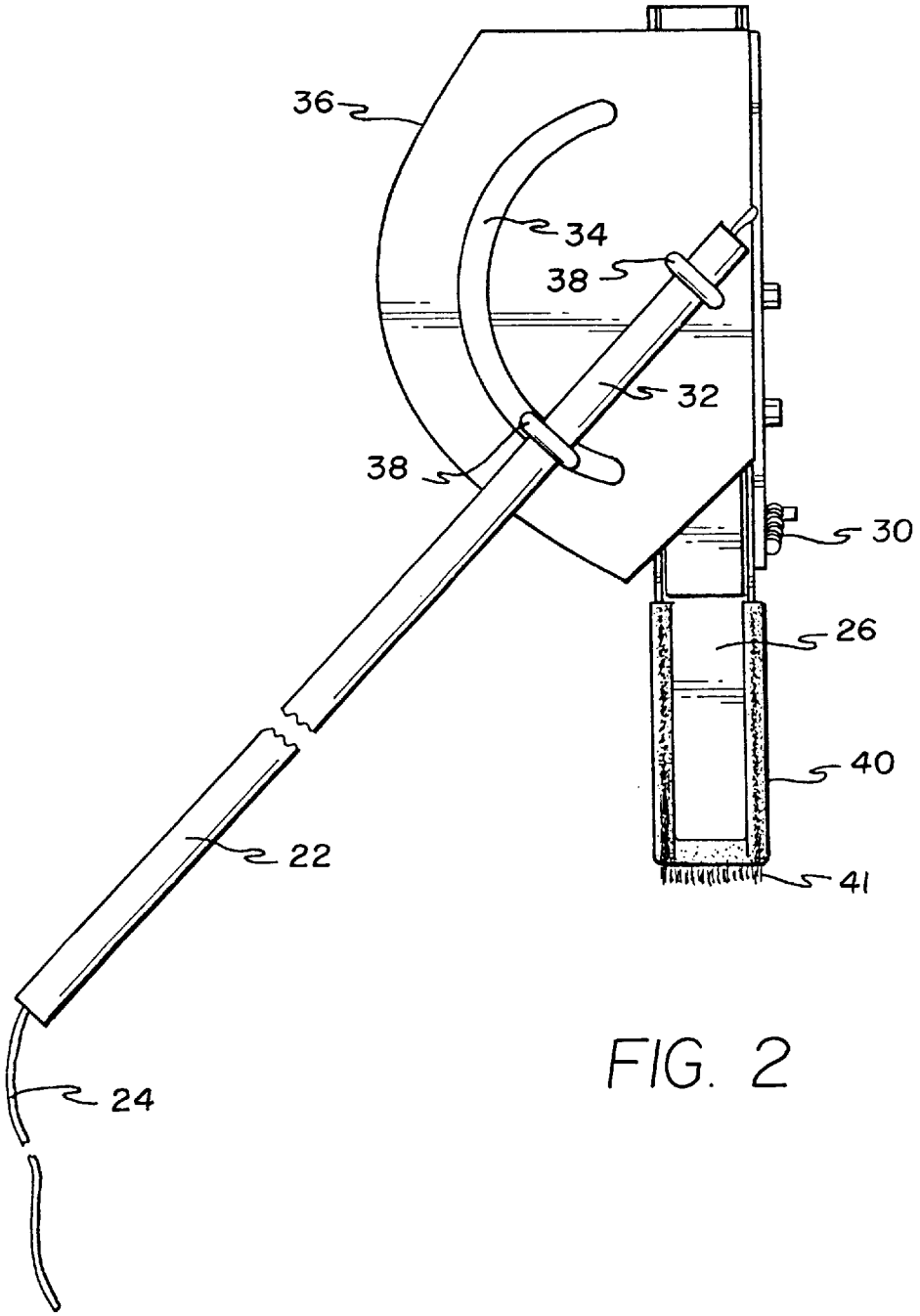
FIG. 2 is a partial front view of the rain gutter cleaner showing the cleaning element in detail.
Figure 4:
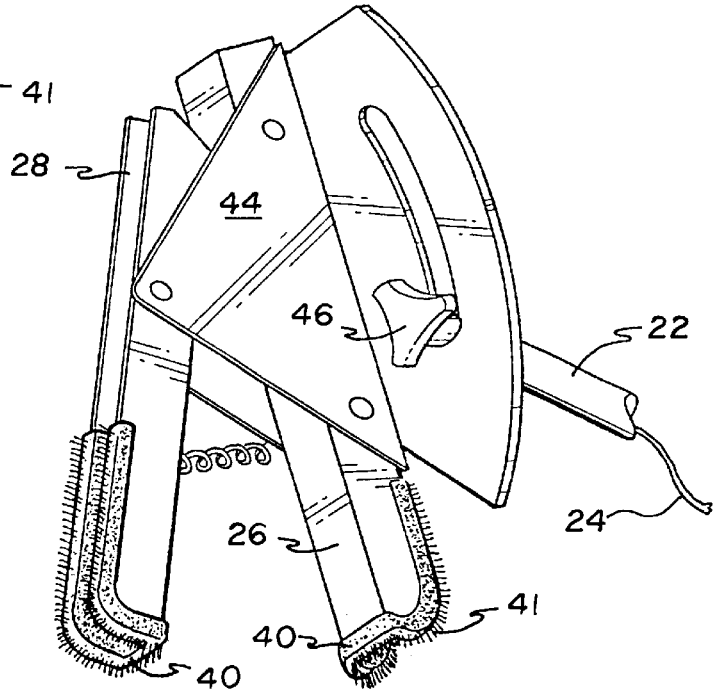
FIG. 4 is a partial rear perspective view of the rain gutter cleaner showing the cleaning element in detail.

Turning to FIG. 2, the pole end 32 is held in the groove or curved aperture 34 of the grooved plate 36 in a fixed position by a ring bolt 38. secured by a fastener 46 (FIG. 4) or a washer and nut (not shown). The top end 32 is held securely to the grooved plate 36 and the fixed jaw 26 by another ring bolt 38 and a similar fastener. The fixed jaw 26 and the hinged jaw 28 are channel pieces with curved external ends covered with plastic guard pieces 40 having bristles 41. The guard pieces 40 and bristles 41 are designed to scrape the bottom and sides of the rain gutter 14 or the valleys of a roof (not shown).

Figure 3:
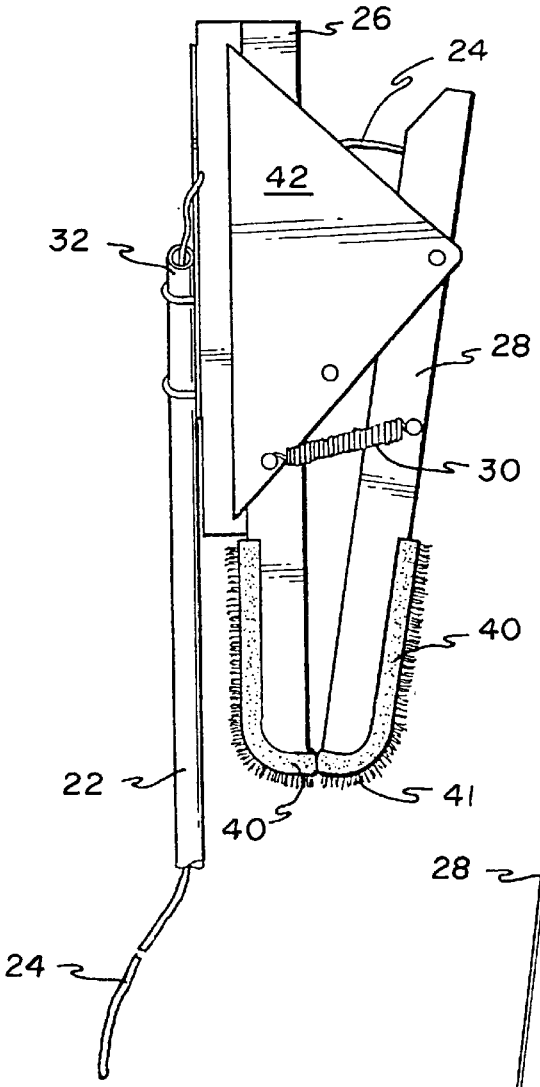
FIG. 3 is a partial right side view of the rain gutter cleaner showing the cleaning element in detail.

In FIG. 3, the positions of the spring 30 and the cable 24 are illustrated to show the clamping movement of the jaws 26 and 28. The triangular plate 42 is affixed to the fixed jaw 26 at two points and provides a pivot for the movable jaw 28. Pulling on the cable 24 from below expands the jaws and the spring 30. When pick up of the debris is desired, the cable 24 is released and the contracting spring 30 provides the clamping force necessary to hold the debris until lifted out of the gutter 14.

It is to be understood that the present invention is not limited to the embodiment described above, but encompasses any and all embodiments within the scope of the following claims.

I claim:

1. A rain gutter cleaner apparatus comprising:

a telescoping elongated tubular pole having a top end and a bottom end;

a cleaning element attached to said top end of said pole including:

(1) a fixed U-channel jaw, a movable U-channel jaw and a U-shaped triangular bracket, said movable U-channel jaw pivoting in said U-shaped triangular bracket;

(2) said movable jaw having a spring connecting said movable jaw to a portion of said bracket;

(3) a cable connected to a portion of the movable jaw opposite to said spring; and (4) a plate with an arcuate groove attached to said fixed U-channel jaw to cover the open channel partially, said plate accepting said top end of said pole, there further being a pivoting means confined in said arcuate groove and a fastener means attached to said pole, whereby the angle of inclination between said pole and said cleaning element can be varied, and wherein said cable extends from said cleaning element through said telescoping elongated tubular pole and out said bottom end of said pole;

whereby a user can pile any debris and clean the gutters and valleys by picking up the debris with closed jaws to pick up the piled debris by manipulating said cable.

2. The rain gutter cleaner apparatus according to claim 1, wherein said cable emerges from proximate said bottom end of said telescoping pole through an aperture and is secured by a sleeve and a clamp.

3. The rain gutter cleaner apparatus according to claim 1, wherein said jaws have outside curved ends, there further being plastic guard pieces covering said curved ends.

4. The rain gutter cleaner apparatus according to claim 3, wherein said jaws each include an outside.surface, said guard pieces with bristles being located on said outside surfaces.

5. The rain gutter cleaner apparatus according to claim 1, wherein said telescoping tubular pole and said cleaning element are made substantially of metal.

6. The rain gutter cleaner apparatus according to claim 5, wherein said metal is aluminum alloy.

7. The rain gutter cleaner apparatus according to claim 1, wherein said cable is a braided steel cable.

* * * * *